United States Patent [19]

Patel et al.

[11] Patent Number: 4,600,053

[45] Date of Patent: Jul. 15, 1986

[54] HEAT EXCHANGER STRUCTURE

[75] Inventors: Ramchandra L. Patel, Southgate; Chhotubhai N. Patel, Farmington Hills, both of Mich.

[73] Assignee: Ford Motor Company, Dearborn, Mich.

[21] Appl. No.: 674,385

[22] Filed: Nov. 23, 1984

[51] Int. Cl.[4] ..... F28F 3/14; F28D 1/02

[52] U.S. Cl. ..... 165/170; 165/153; 29/157.3 D

[58] Field of Search ..... 165/153, 170, 166, 167, 165/152; 29/157.3 D, 157.3 R

[56] References Cited

U.S. PATENT DOCUMENTS

| | | | |
|---|---|---|---|
| 2,158,383 | 5/1939 | Saunders | 165/170 |
| 2,312,451 | 3/1943 | Strike | 29/157 R |
| 2,699,324 | 1/1955 | Goodman | 165/167 |
| 2,959,400 | 11/1960 | Simpelaar | 165/166 |
| 4,011,905 | 3/1977 | Millard | 165/166 |
| 4,081,025 | 3/1978 | Donaldson | 165/153 |
| 4,120,351 | 10/1978 | Kleine et al. | 165/170 |
| 4,182,399 | 1/1980 | Popplewell | 165/170 |
| 4,184,543 | 1/1980 | Kleine et al. | 165/170 |
| 4,209,064 | 6/1980 | Cacalloro et al. | 165/170 |
| 4,249,597 | 2/1981 | Carey | 165/166 |
| 4,470,455 | 9/1984 | Sacca | 165/153 |

FOREIGN PATENT DOCUMENTS

| | | | |
|---|---|---|---|
| 24631 | 9/1935 | Australia | 165/152 |
| 2727219 | 1/1979 | Fed. Rep. of Germany | 29/157.3 D |
| 567223 | 2/1924 | France | 165/170 |
| 615715 | 1/1961 | Italy | 165/152 |
| 0071796 | 6/1981 | Japan | 165/166 |
| 548196 | 9/1942 | United Kingdom | 165/166 |

*Primary Examiner*—William R. Cline
*Assistant Examiner*—John K. Ford
*Attorney, Agent, or Firm*—William E. Johnson; Clifford L. Sadler

[57] ABSTRACT

This specification relates to a heat exchanger (10) of the type wherein a plurality of elongated plates (12) are laminated together to define a plurality of passageways (14) for movement of a fluid therethrough. Each of the passageways (14) are formed by inwardly facing surfaces of a pair of laminated plates (12—12) which define a central fluid conducting section (34) located between reservoir sections (32—32) at each end thereof. Adjacent of the passageways (14—14) have heat transfer fins (18—18) located therebetween. Reservoir sections (32—32) of adjacent ones of the passageways (14—14) are interconnected so that a fluid may flow therethrough. The improvement of this invention is made to the laminated plates and it includes a plurality of beads formed on each of the pair of laminated plates (12—12). The beads formed on each of the plates are of two distinct varieties. A first variety of the beads (40-1) extends above a surface of each laminated plate (12) and terminates in a relatively flat upper surface. A second of the variety of beads (40-2) extends above a surface of each laminated plate (12) and terminates in a bowed upper surface. The first and the second variety of beads (respectively 40-1 and 40-2) are so constructed and arranged that the first variety of beads (40-1 on one of the elongated plates (12) are in bonding contact with the second variety of beads (40-2) on the other of the pair of laminated plates (12) and vice-versa.

1 Claim, 5 Drawing Figures

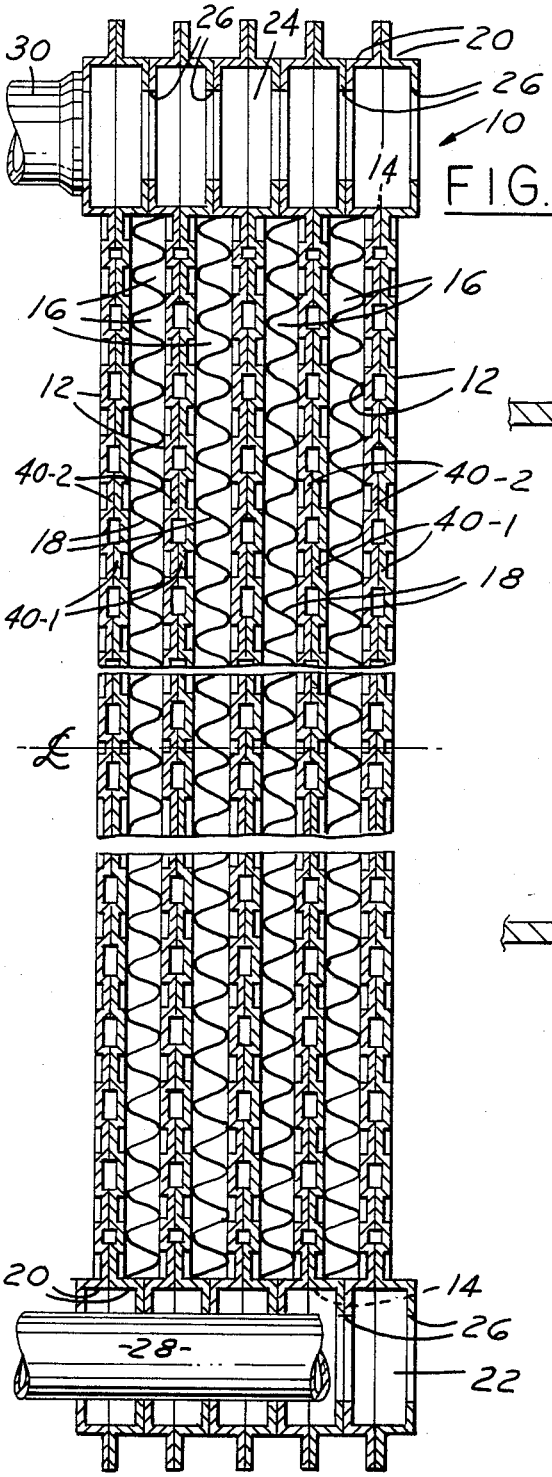
FIG.1
FIG.4
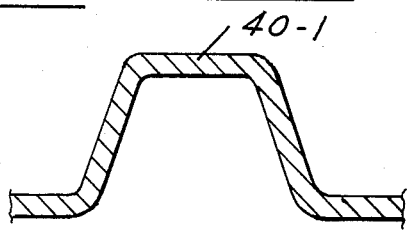
FIG.3
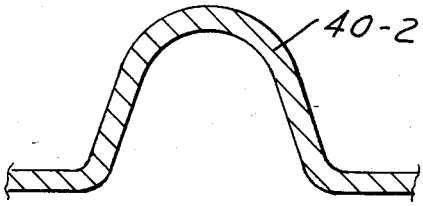

HEAT EXCHANGER STRUCTURE

TECHNICAL FIELD

This application is directed to an improvement in heat exchanger structures. The particular improvement set forth in this specification is one which results in the establishment of a greater plurality of flow paths for a fluid to be cooled in each of a plurality of passageways through which the fluid flows to be cooled in the heat exchanger structure.

BACKGROUND AND PRIOR ART STATEMENT

The art is well aware of heat exchangers of the type made by laminating together a plurality of elongated plates to define a plurality of passageways for movement of a fluid therethrough. Each of the passageways is formed by the inwardly facing surfaces of a pair of laminated plates. The interior surfaces of the laminated plates generally define a central fluid conducting section located between reservoir sections at each end thereof.

As known in the art, adjacent of the passageways defined by the laminated plates have heat conductive fin strips located between juxtaposed, outwardly facing surfaces thereof. Adjacent ones of the reservoirs of the passageways are interconnected so that a fluid may flow through the plurality of laminated plates forming the heat exchanger. Heat exchangers of this type have particular utility as an evaporator for an air conditioning system in a motor vehicle.

This invention is directed to an improvement in this structure, which improves the heat transfer coefficient of the heat exchanger. The heat transfer coefficient of the heat exchanger is improved by establishing a multiplicity of pathways for the fluid to flow through each passageway so a greater turbulence is obtained and a greater mixing of the fluid to be cooled is also obtained . As an additional factor, the structure of our invention also increases the overall strength of the heat exchanger in its resistance to high pressures can be encountered during the passage of the fluid to be cooled therethrough.

A search on our improved structure was conducted in the U.S. Patent and Trademark Office. As a result of this search the following U.S. Pat. Nos. were cited: 3,312,451; 4,120,351; 4,182,399; 4,184,543; and 4,209,064. We shall discuss these patents briefly. However, we would like to say that we feel none of these patents either teach or suggest the particular structure which we will describe and claim in this specification.

U.S. Pat. No. 2,312,451, issued on Mar. 2, 1943, for "Welding Process." The welding process disclosed was used to produce a hollow body comprising rolled, recessed, complimentary heated elements. The method disclosed included rolling the complimentary elements together while still hot with recesses facing each other thereby to weld the element together by heat and pressure and simultaneously bending the body during the welding to impart substantially uniform curvature in one direction.

U.S. Pat. No. 4,120,351, issued on Oct. 17, 1978, for "Heat Exchanger Panel With Improved Header." The heat exchange panel disclosed possessed a system of internal tubular passageways connecting opposed headers at an angle of at least 91° with respect to the direction of flow of a heat exchange medium passing therethrough. In this manner the headers are triangular in shape and the fluid entry and exit portions extend from the header in such a manner that they are provided with their longitudinal dimensions lying in substantially the same plane as one of the sides defining the outer boundaries of the headers.

U.S. Pat. No. 4,182,399, issued on Jan. 8, 1980, for "Process for Removing Heavy Metal Ions From Aqueous Fluids." This patent related to an improved method for removing corrosive heavy metal ions from aqueous fluids used in heat exchange systems. The method taught provides for the employment of a getter upstream of a heat exchange and in proximate contact therewith so that the getter removes the ions from the fluid before the fluid is introduced into the heat exchanger.

U.S. Pat. No. 4,184,543, issued on Jan. 22, 1980, for "Heat Exchanger Exhibiting Improved Mechanical and Thermal Stability." This patent disclosed a heat exchanger having a desired system of tubular passageways for a heat exchange medium. The heat exchanger was defined by opposite headers connected by connecting portions of the passageways extending therebetween. The passageways have entry and exit portions extending from the headers to provide ingress and egress openings for the heat exchange medium.

U.S. Pat. No. 4,209,064, issued on Jan. 24, 1980, for "Panel-Type Radiator for Electrical Apparatus." The patent teaches that the panel-type radiator extracts heat from fluid flowing therethrough. The radiator comprises a panel through which the fluid flows in a downward direction. The panel is made from two dished metal sheets having a line of vertical extending embossments welded together along a vertically extending zone and providing spaced vertically extending flow channels on opposite sides of the vertically extending zone. The portions of the sheets defining the walls of the channels are provided with vertically spaced embossments arranged on each sheet in a generally herringbone pattern with individual embossments extending transversely of the vertically extending zone via a path that slopes upwardly as the vertically extending zone is approached.

As is stated above, we feel that this prior art does not teach or disclose the invention to be taught and claimed in this specification. The reasons for this will become apparent when one examines the cited art and reads the remainder of this specification.

DISCLOSURE OF INVENTION

This invention relates to a heat exchanger and more particularly to an improved heat exchanger having a better heat transfer coefficient.

The improvement is one which is made to a heat exchanger. In particular, the heat exchanger is of the type wherein a plurality of elongated plates are laminated together to define a plurality of passageways for movement of a fluid therethrough. Each of the passageways is formed by inwardly facing surfaces of a pair of laminated plates. The pair of laminated plates define a central fluid conducting section located between reservoir sections at each end thereof. When a plurality of laminated pairs of plates are assembled to form a structure defining a plurality of passageways, adjacent of the passageways are so constructed and arranged that heat conductive fin strips are located between juxtaposed, outwardly facing surfaces thereof. In this structure, reservoirs of adjacent ones of the passageways are interconnected so that a fluid may flow through the passageways defined by the plurality of laminated plates forming the heat exchanger.

In this environment our improvement is situated. The improvement is one which is made to the laminated plates. The improvement comprises a plurality of beads formed in each of the pair of plates forming one of the passageways. The beads are formed on each of the laminated plates and are of two distinct varieties. A first variety of the beads extend above a surface of each laminated plate and terminates in a flat upper surface. A second of the variety of beads extend above a surface of each laminated plate and terminates in a bowed upper surface. The first and the second variety of beads on each laminated plate are so constructed and arranged that when a pair of the plates are laminated together the first variety of beads on one of the elongated plates are in bonding contact with the second variety of beads on the other of the pair of laminated plates and vice-versa. In this manner the heat exchanger has a plurality of flow paths established for the fluid in each of the passageways and the overall strength of the heat exchanger is improved.

In accordance with detailed teachings of the preferred embodiment of the structure of our invention, beads of the first and second variety are placed on each of the elongated plates in the same manner, and when two identical plates are paired, one on top of the other, the first variety beads on one plate are in contact with the second variety beads on the other plate and vice-versa to achieve the structure described above.

BRIEF DESCRIPTION OF THE DRAWINGS

The novel features that are considered characteristic of the invention are set forth with particularlity in the appended claims. The invention itself, however, both as to its organization and its method of operation, together with additional objects and advantages thereof, will best be understood from the following description of specific embodiments when read in connection with the accompanying drawings, wherein like characters indicate like parts throughout the several figures, and in which:

FIG. 1 is a cross-sectional view of the heat exchanger which includes the improved structure of this invention;

FIG. 3 is a cross-sectional view of a first variety of bead taken along line III—III of FIG. 2;

FIG. 4 is a cross-sectional view of a second variety of bead taken along line IV—IV of FIG. 2.

BEST MODE AND INDUSTRIAL APPLICABILITY

Figure 2:
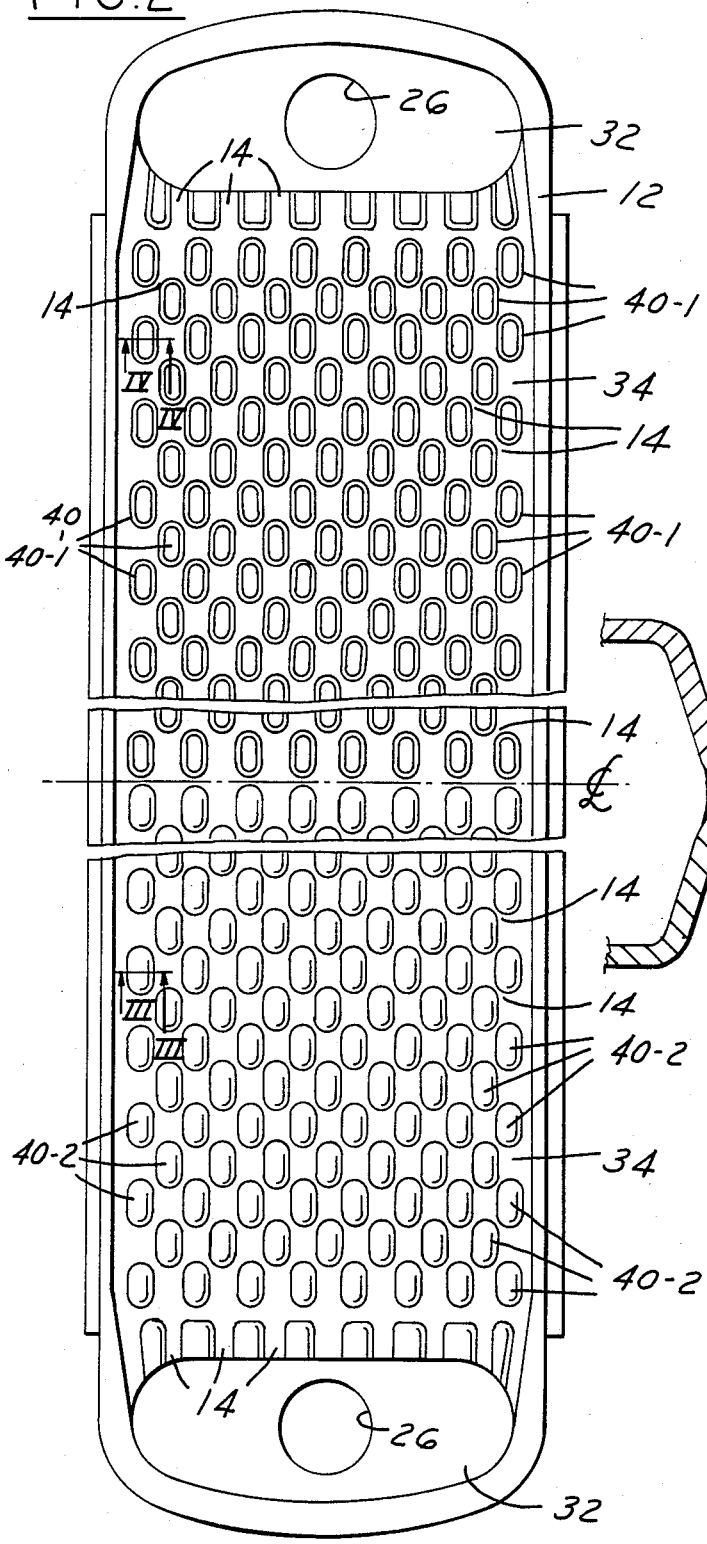
FIG. 2 is a view of an elongated plate having a plurality of beads thereon, the structure being formed in accordance with the teachings of this invention.

The following description is what we consider to be a preferred embodiment of the heat exchanger improved in accordance with our inventive construction. The following description also sets forth what we now contemplate to be the best mode of constructing our inventive heat exchanger. The description is not intended to be a limitation upon the broader principles of this construction, and while preferred materials are used to form the construction in accordance with the requirements of the laws, it does not mean that other materials cannot be used to make this construction.

Referring now the drawing, FIG. 1 shows a plate and fin heat exchanger, generally designated by the numeral 10, in the form of an evaporator particularly adapted for use in an automobile air conditioning system. The heat exchanger 10 comprises a stack of formed, elongated plates 12, pairs of which are laminated together in a face-to-face relationship so that adjacent pairs provide alternate passageways 14 (best seen in FIG. 2) for the flow of a refrigerant and air side spaces 16 for the flow of air. Heat transfer fins 18 are positioned within the air spaces to provide increased heat transfer area as is well known in the art.

Ends 20 of the adjacent pairs of plates 12 are formed to provide outlet and inlet headers 22 and 24, respectively. The headers are walled chambers that are in direct communication with the passageways 14. The headers also have aligned apertures 26 in their side walls providing communication between the respective header chambers.

The inlet header 24 has an inlet pipe 30 associated therewith for introduction of a refrigerant. In a similar manner, the outlet header 22 has an outlet pipe 28 associated therewith so that refrigerant may be conducted away from the heat exchanger 10 after it passes through the plurality of passageways 14—14 defined by the assembled elongated plates 12—12.

The manufacture of the plate and fin heat exchanger 10 is accomplished in a manner well known in the art. The plurality of formed elongated plates are generally formed from an aluminum material coated with an aluminum brazing alloy. The various elements used to form the entire unit are made from aluminum stock then assembled, as shown in FIG. 1, and passed through a vacuum brazing operation in which the metal brazes together in order to form the completed article.

As will be described hereinbelow, the improved heat exchanger of this invention is one wherein a greater number of passageways are created for the distribution of the fluid for heat rejection purposes and greater rigidity for the entire structure is achieved as a result of the brazing operation. Before detailing the improvement of this invention, for the purpose of the remaining portion of this specification and claims herein, the ends of each plate 12 (as best seen in FIG. 2) through which the apertures 26—26 are formed will generally be referred to as the reservoir sections 32—32 of the plate. The numeral 32 is shown only in FIG. 2. The reservoir sections are located at each end of an individual plate and there is a central fluid conducting section 34 (shown in FIG. 2) located between the two reservoir sections.

As mentioned above, the heat exchanger of this invention is a heat exchanger 10 which includes a plurality of elongated plates 12—12 laminated together. These plates are laminated together in order to define a plurality of passageways 14—14 generally located in the fluid conducting section 34 of the laminated pair of plates. This fluid conducting section is located between the reservoir sections 32—32, which respectively form part of the inlet header 24 and the outlet header 22 of the heat exchanger. The reservoir section allows fluid to flow in either parallel or parallel-series arrangement with a baffling arrangement in passageways 14—14. Such constructions are known to skilled artisans. As previously noted, adjacent of the pairs of laminated elongated plates are so constructed and arranged that heat transfer fins 18 are located between juxtaposed outwardly facing surfaces thereof (as shown best in FIG. 1).

The improvement to this type of heat exchanger 10 of our invention is as follows. As best seen in FIG. 2, a plurality of beads 40—40 are formed in each of the plates 12—12 forming the heat exchanger. The beads so-formed on each of the plates are of two distinct varieties, and in the drawings are identified by the numerals 40-1 for one variety and 40-2 for the other variety. As best seen in FIG. 2, all of the beads of the first variety 40-1 are in the upper part of the plate 12, while all of the beads 40-2 of the second variety are in the lower part of the plate 12.

Figure 5:
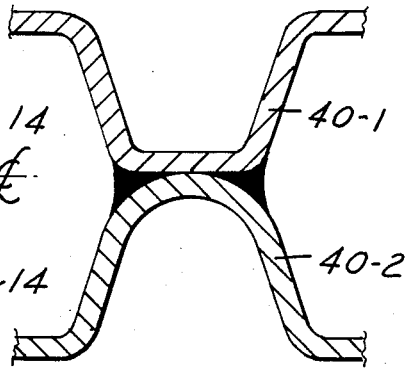
FIG. 5 is a cross-sectional view showing the bonding of the first type and the second type of beads of an elongated plate.

The first variety of beads 40-1 extend above a surface of each plate and terminate in a flat upper surface. The first variety of bead is shown as a single bead in FIG. 3. The second variety of beads extend above a surface of the plate 12 and terminate in a bowed upper surface. This second variety of bead is shown individually in FIG. 4 as a gently curved surface As is best seen in FIG. 2, with the first variety of beads located above the center line of the plate 12 and the second variety of bead located below the center line of the plate 12, the first and the second variety beads are so constructed and arranged that when a pair of the plates 12—12 are laminated together in an overlying condition, the first variety of beads 40-1 on one of the elongated plates are in bonding contact with the second variety of beads 40-2 on the other of the pair of laminated plates. This condition is shown specifically in FIG. 5. In this manner, each pair of laminated plates has a plurality of positively bonded together beads 40-1 and 40-2 which force fluid to flow therearound.

By this construction, a substantial plurality of flow paths are established for the fluid flowing in each passageway 14, whereby a thorough mixing of the fluid is obtained at lower friction which produces a lower overall pressure drop, and an excellent heat rejection is also obtained. Furthermore, because of the multiplicity of points at which the laminated plates 12—12 are bonded together, the overall strength of the heat exchanger 10 is vastly improved over prior known constructions.

Patterns other than that shown specifically shown in FIG. 2 may be used for arranging the first variety and the second variety of beads. The single factor required is that when the pair of plates are laminated together a first variety bead will come in contact with a second variety of bead so that a solid bonding contact is formed therebetween when the materials are subsequently laminated together in the vacuum brazing operation.

While particular embodiments of the invention have been illustrated and described, it will be obvious to those skilled in the art that various changes and modifications may be made without departing from the invention and it is intended to cover in the appended claims all such modifications and equivalents as fall within the true spirit and scope of this invention.

We claim:

1. In a heat exchanger of the type wherein a plurality of elongated plates are laminated together to define a plurality of passageways for movement of fluid therethrough, each of said passageways being formed by inwardly facing surfaces of a pair of laminated plates which define a central fluid conducting section located between reservoir sections at each end thereof, wherein adjacent of said passageways are so constructed and arranged that heat conductive fin strips are located between juxtaposed, outward facing surfaces thereof; and wherein reservoirs of adjacent ones of said passageways are interconnected so that the fluid may flow through said plurality of laminated plates forming the heat exchanger, the improvement to said laminated plates which comprises:

a plurality of beads formed in each of the pair of laminated plates forming one of said passageways, said beads formed on each of said laminated plates being of at least two distinct varieties, a first variety of said beads extending above a surface of each laminated plate and terminating in a relatively flat upper surface, and a second of said variety of said beads extending above a surface of each laminated plate and terminating in a bowed upper surface, said plurality of said first variety of said beads being on one side of a center line of each of said laminated plates and said second variety of said beads being on the other side of said center line of each of said pair of laminated plates wherein each of said laminated plates is of identical design and wherein said first and said second variety of beads on facing plates are laminated together said first variey of beads on one of said elongated plates are bonded directly to said second variety of beads on said other of said pair of laminated plates and vice-versa, whereby said heat exchanger has a plurality of flow paths established for the fluid in each of said passageways and whereby the overall strength of the heat exchanger is improved and only one type of plate is used to form the heat exchanger.

* * * * *